United States Patent [19]

Powers

[11] 4,016,620

[45] Apr. 12, 1977

[54] PIPELINE CLEANING PIG

[75] Inventor: Marvin D. Powers, Houston, Tex.

[73] Assignee: Pipeline Dehydrators, Inc., Houston, Tex.

[22] Filed: May 22, 1975

[21] Appl. No.: 580,109

[52] U.S. Cl. ..... 15/104.06 R

[51] Int. Cl.[2] ..... B08B 9/04

[58] Field of Search ..... 15/104.06 R, 104.06 A; 137/268

[56] References Cited

UNITED STATES PATENTS

| | | | |
|---|---|---|---|
| 3,389,417 | 6/1968 | Knapp et al. | 15/104.06 R |
| 3,602,934 | 9/1971 | Reed | 15/104.06 R |
| 3,875,606 | 4/1975 | Landers | 15/104.06 R |
| 3,879,790 | 4/1975 | Girard | 15/104.06 R |

*Primary Examiner*—Edward L. Roberts
*Attorney, Agent, or Firm*—Michael P. Breston

[57] ABSTRACT

This invention provides a pig adapted for cleaning material from the inner wall of a pipeline and for assisting in the removal of this material from the pipeline. The pig comprises a cylindrical, open cell foam core. An impervious jacket covers the outer wall of the core. An opening in at least one end wall allows the pressurized fluid inside the pipeline to permeate the core. An abrasive means completely covers the outer cylindrical surface of the jacket. The abrasive means preferably is a layer of hardened steel bristles attached to a web backing. The tips of the steel bristles are bent in a longitudinal plane in the direction of travel of the pig.

7 Claims, 7 Drawing Figures

FIG. 1.
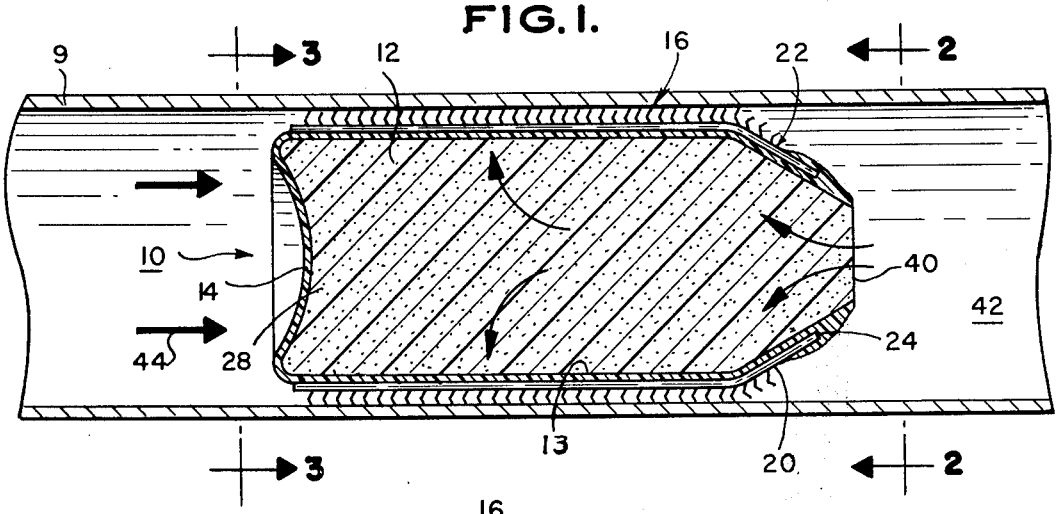
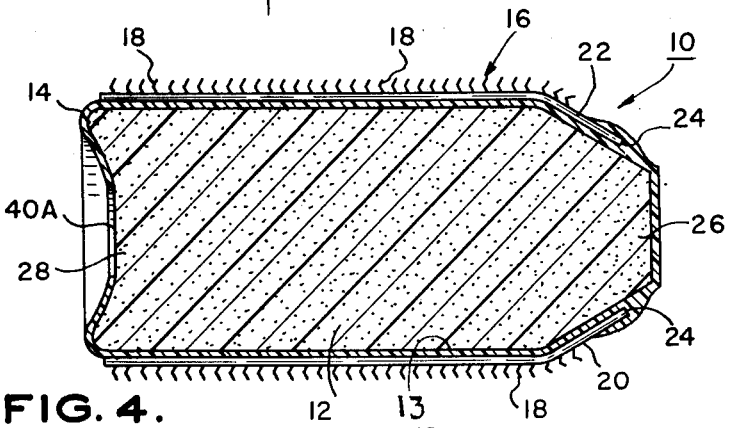
FIG. 4.
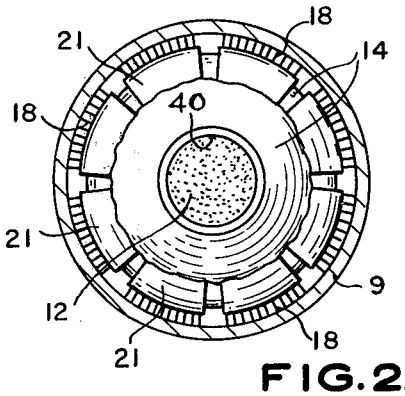
FIG. 2.
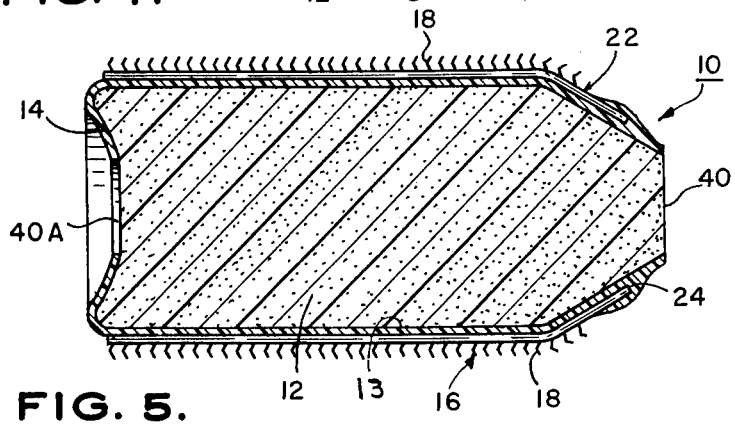
FIG. 5.
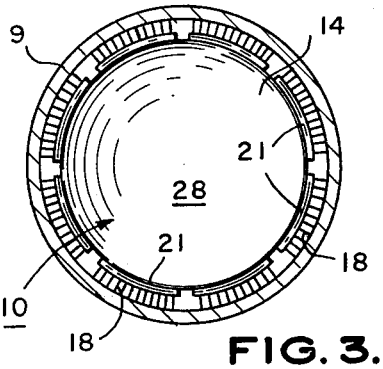
FIG. 3.
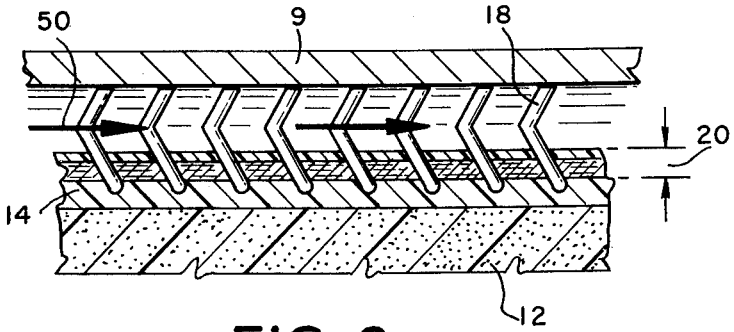
FIG. 6.
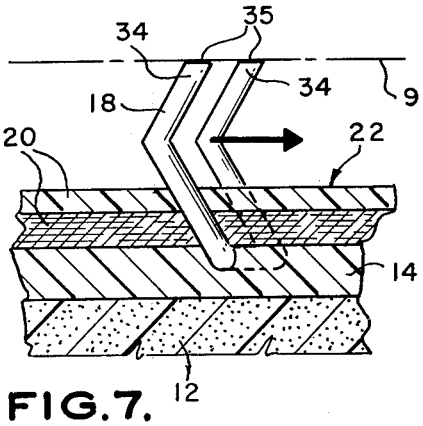
FIG. 7.

PIPELINE CLEANING PIG

BACKGROUND OF THE INVENTION

Cleaning pigs are propelled through a pipeline by a pressurized fluid as described, for example, in U.S. Pat. Nos. 3,389,417, 3,204,274 and 3,474,479. Some such pigs are made of a flexible, polyurethane foam, cylindrical body. It was believed essential that the body's outer cylindrical surface be only partially covered with spiraling bands of an abrasive material, such as a layer of steel bristles. The rear and front end walls of the cylindrical foam body are typically covered with an impervious coating designed to form a moving seal with the inner wall of the pipe. The pressure gradient between the pig's rear and front end walls, incurred by the pig due to its resistance to movement caused by the frictional drag on the wall of the pipe, causes the pig to shorten axially, whereby the portions of the foam body between the spiraling abrasive bands extend radially outwardly for the purpose of creating a moving seal between the foam body and the inner wall of the pipe. Both the rear end seal provided by the coating and the outwardly and radially extending foam portions between the spiraling abrasive bands are intended to prevent propelling fluid from flowing through or around the pig.

In practice it has been found that while the portions of the foam body between the spiraling abrasive bands do extend outwardly, the abrasive bands themselves become pushed inwardly by the inner wall of the pipe. The abrasive bands easily compress the foam thereunder and force it outwardly between the abrasive bands, thereby reducing the bands' abrasive effect. Since the foam is the weakest structural member of the pig's structure, the working life of the pig will be determined by the strength of the bare and exposed foam portions between the abrasive bands. But when the foam is stretched and contorted by the stresses produced thereon inside a pipeline, such as when the pig negotiates a bend or reduced opening, the foam easily tears because it poorly resists tensile forces.

Another problem with the conventional construction of such a pig is that it allows for no appreciable fluid flow through the bristles to clean them. The debris removed from the pipe's wall gradually collect between the bristles on the abrasive bands. Such debris further push the abrasive bands radially inwardly, thereby further reducing their abrasive effectiveness. Some of these debris become inhaled by the exposed open-cell foam and move inside the foam's pores. As a result, the collected solids greatly increase the original weight of the pig and reduce the flexibility of the foam. The debris that are not collected inside the bristles and that are not absorbed into the open cell foam are left behind the pig and remain in the pipeline, requiring at least another pig run.

In sum, the above enumerated conditions result in that the foam in conventional pigs becomes heavy, inflexible and torn, the bristles become clogged and ineffective, until the pig finally desintegrates and the abrasive bands tear away from the foam body.

In addition to the above, the relatively short working life of such known pigs is attributed to a variety of other causes, such as the irregularities of the inner wall of the pipe, including the pitted surfaces, circumferential and longitudinal weld seams, and the passage through bends, valves, restrictions, fittings, etc. As a result, the foam core is put in tensile stress causing it to wear, tear or become clogged with debris. Thereafter, the worn-out pig can only have a very limited working life.

In an attempt to prolong the working life of the known pigs, it was suggested to improve the seal between the foam and the inner wall of the pipe, by increasing the abrasive surface in contact with the wall of the pipe, and by leaving suitably-disposed openings in the abrasive surface through which the foam material can expand radially outwardly into wiping contact with the inner wall of the pipe. It was believed that these openings must be so constructed that the portions of the foam projecting outwardly therethrough should form an effective circumferential seal with the inner wall of the pipe, thereby preventing the flow of propelling fluid around the pig, between the rear and front end walls thereof, in the direction of propulsion.

Thus, the above described known pigs are all characterized by an attempt to maintain an effective seal between selected exposed portions of the foam and the inner wall of the pipe.

Unfortunately, the exposed foam portions in contact with the pipe's inner wall shorten the working life of the pig, and cause a relatively inefficient scraping action by the abrasive bands mounted on the outer cylindrical wall of the pig. These bands, in use, are pushed radially inwardly by the pipe and by the debris trapped between the bristles, while portions of the foam core between these bands move radially outwardly, thereby reducing the scraping effectiveness of the bristles. Other disadvantages of the prior art pigs of the above described character will subsequently become apparent.

SUMMARY OF THE INVENTION

In the pig of this invention the resilient, open cell, cylindrical foam core is covered by a flexible impervious jacket. An opening is provided in either the front end, or the rear end, or in both ends of the jacket. An abrasive material, such as a layer of steel bristles, substantially uniformly covers the external surface of the jacket. The tips of the bristles are preferably oriented in a longitudinal plane and are bent in the direction of propulsion for the most effective scraping action thereof on the surrounding inner wall of the pipe.

In the presently preferred embodiment, the opening in the impervious jacket is only in the front end of the pig. Pressurized fluid from the downstream section of the pipeline, in front of the pig, permeates the pig's foam. When fabricated, the outside diameter of the pig is made slightly larger than the inside diameter of the pipeline, so that the bristles, in use, will be pushed outwardly, by the resilience of the compressed foam, for abrasive contact with the surrounding inner wall of the pipe.

When the opening in the jacket is only at the rear end of the pig, the relatively higher pressure fluid from the upstream section at the rear end of the pig permeates the pig's foam body. Therefore, in this case, in addition to the outward pressure produced by the resilience of the foam, the fluid pressure differential across the pig's body in the direction of travel, also forces the steel bristles into even greater abrasive contact with the inner wall of the pipe.

For very tough cleaning jobs, it becomes desirable to have the opening only at the rear end of the pig, however, more pressure and greater volume of the propelling fluid may be required. For normal cleaning jobs the opening should be at the front end of the pig. Less difficulty will be encountered when running the pig if the opening is in the front end.

The pig is effective and may be constructed with the opening at the front and at the rear ends of the pig. In this case, a portion of the propelling fluid will escape through the opening in the front end.

The web backing carrying the bristles is secured to the foam by a suitable adhesive which can also serve as the impervious jacket covering the pig. The web backing holding the steel bristles takes all of the tensile stresses imposed on the pig. The web backing is many times stronger than the foam thereby giving the pig a longer working life.

In accordance with an important aspect of this invention, the tips of the bristles are bent forward in the direction of travel and are substantially contained in a longitudinal plane.

BRIEF DESCRIPTION OF THE DRAWINGS

FIG. 1 is a longitudinal sectional view of the preferred embodiment of the pig, with an opening in the front end of the jacket, shown inside a pipeline and being propelled by a pressurized gas;

FIGS. 2 and 3 are front and rear end views of the embodiment of the pig shown in FIG. 1, respectively;

FIG. 4 is a longitudinal sectional view of an alternate embodiment with an opening in the rear end of the jacket;

FIG. 5 is a longitudinal sectional view of another embodiment with an opening in the rear and in the front ends of the jacket;

FIG. 6 is a fragmentary, longitudinal sectional view showing the scraping action of the steel bristles; and FIG. 7 is an enlarged view of a single bristle.

A typical prior art pig (not shown) comprises a core made of polyurethane form having a density which allows the pig to be sufficiently flexible for passage through curves and obstructions in the pipeline. A spiralling band of web backing carries short steel bristles. The backing is secured to the foam by a suitable adhesive. Between these web bands remain exposed foam bands. To the rear and front end walls of the pig are respectively affixed continuous, impervious covers made of a soft material possessing elastomeric qualities.

In operation, the prior art pig of the foregoing character is inserted into a pipeline and a fluid under pressure is exerted against the rear cover of the pig which is intended to form a moving seal with the interior wall of the pipe. The pressure differential between the rear and front covers, i.e., across the pig, causes the pig so slightly contract along its longitudinal axis, whereby the exposed foam bands are forced outwardly for the purpose of establishing a moving wiping seal with the interior wall of the pipe. This seal is intended, in accordance with an important object of the prior art, to prevent the propelling fluid from flowing around and past the pig between the front and rear ends thereof in the direction of propulsion.

In use of the prior art pig as above described, the web bands which carry the bristles become slightly pushed inwardly by compressing the foam. A movement of the web bands inwardly, away from the pipe's inner wall, is accompanied by a reduction in the abrasive effectiveness of the bristles because the foam thereunder is forced outwardly between the bands. Since the foam cannot withstand much abrasion, it tends to tear especially when contacting rough spots in the pipe's inner wall. Once a tear starts, it accelerates rapidly until the usefulness of the pig as a cleaning tool becomes of little value.

Referring now to the drawings, the pig of this invention is generally designated as 10. The pig has a foam core 12 whose outer wall 13 is covered with a flexible impervious jacket 14. This jacket is preferably made from adhesive material and is covered by an abrasive 16. The abrasive material can be made from sand, glass, diamond dust, silicone carbides, etc. Preferably the abrasive material is of the type that contains short, hardened steel bristles 18 embedded in a web backing 20 which forms a sleeve 22 secured to the outer wall of core 13 by the adhesive which forms the jacket 14. Sleeve 22 can be made from a plurality of parallel strips 21 (FIG. 2), or it may be constructed from a continuous one piece. The strips 21 of the web backing will all extend in the longitudinal direction and be positioned next to each other (FIGS. 2, 3) on the outer cylindrical surface of the foam core 12. The front ends 24 (FIG. 4) of the strips 21 are secured to the conical or dome-shaped front end 26 of core 12 by the adhesive.

Each steel bristle 18 is contained in a longitudinal plane and has a tip 34 which is slightly bent in the direction of propulsion, as bent shown in FIGS. 6 and 7. Tip 34 presents a smooth sliding surface 35.

In the preferred embodiment shown in FIGS. 1–3, the front end 26 is preferably covered with the impervious adhesive material except for a center opening 40, while the rear end 28 is completely covered with the adhesive material. In this manner, the fluid from the downstream section 42 of the pipeline 9 completely permeates the pig's foam core 12.

In use of the preferred embodiment, as the pressurized fluid 44 propels pig 10 downstream through pipeline 9, the fluid fully permeates core 12 through the front opening 40, thereby equalizing the pressure between the downstream pipeline section 42 and the inside volume of the pig. When fabricated, the outside diameter of the pig is made purposely larger than the inside diameter of the pipeline, so that the bristles, in use, will be pushed radially outwardly for abrasive contact with the surrounding inner wall of the pipe, by the resilience of the compressed foam. The resiliency of the foam body creates a uniformly distributed pressure against the web backing material 20 thereby tending to force the steel bristles radially outwardly for scraping contact with the inner wall of the pipe.

In a less preferred embodiment (FIG. 4), an opening 40A is provided only in the rear end 28 of the pig. The relatively higher pressure fluid from the upstream section at the rear end of the pig now permeates the pig's foam body. Therefore, in this case, in addition to the pressure produced by the resilience of the foam, the fluid pressure differential across the pig's body, in the direction of travel, forces the steel bristles 34 into greater abrasive contact with the inner wall of the pipe.

Thus for very tough cleaning jobs, it may become desirable to have the opening at the rear end of the pig, however, more pressure and greater volume of propelling fluid may be required to move the pig.

The pig is effective and may also be constructed with openings 40 and 40A at the front and rear ends of the pig, respectively, as shown in FIG. 5. In this embodiment a portion of the propelling fluid will escape through the opening 40 in the front end of the pig.

The moving bristles 18 scrape foreign material off the inner wall of the pipe. The flow 50 of fluid around the pig between and through the interstices of the steel bristles, causes the removed debris to be blown downstream in front of the moving pig. Thus the flow of fluid around or past the pig in a longitudinal direction ensures the self-cleaning of the steel bristles. The web backing protects the foam and the arrangement of the steel bristles makes them self-sharpening. Therefore the pig is a more effective tool and it's useful working life is very long compared to the working life of the above described prior art pigs which are characterized by having portions of the foam body directly engaging the inner wall of the pipe in an effort to establish an effective seal therewith.

In the pig 10 of this invention, no tearing of the foam material takes place. No foam is ever in direct contact with the pipe's wall. Since the tips 34 of the bristles 18 are inclined in a plane passing through the longitudinal axis, they will not tend to sway sideways and pull the abrasive bands off the pig, as was the case with the bristles mounted on the spiral bands of the known pigs. Accordingly, the bristles 18 will do their most effective scratching job on the pipe's wall, while at the same time continuously self-sharpen their uppermost flat surfaces 35 of tips 34 (FIG. 7).

While presently preferred embodiments have been described, modifications may be made therein without departing from the scope of the claims attached hereto.

What is claimed is:

1. A pipeline scrapping pig comprising:

a cylindrical body made of resilient, open-cell foam, a flexible, impervious jacket substantially completely covering the foam, said jacket having an opening in at least one end of the pig, and abrasive means substantially completely covering the outer surface of said jacket, said abrasive means comprising a web backing, and steel bristles projecting outwardly from said backing.

2. The pig of claim 1 wherein said steel bristles are bent forward substantially in the direction of travel of the pig in said pipeline.

3. The scraping pig of claim 2, wherein said body is completely confined by said jacket, whereby, in use, only the abrasive means form a continuous, cylindrical surface adapted for exclusive engagement with the inner wall of the pipeline.

4. A pipeline scrapping pig adapted to become propelled in a pipeline under the influence of a pressurized fluid, comprising:

a core made of resilient, open-cell foam; and abrasive means substantially completely covering the outer wall of said core, said abrasive means including steel bristles, and in use, a portion of said fluid flowing through the interstices between said bristles.

5. The pig of claim 4, and fluid impervious means covering said core, and the rear end of said impervious means having an opening to allow the upstream propelling fluid to permeate said core.

6. The pig of claim 4, and fluid impervious means covering said core, and the front end of said impervious means having an opening to allow the downstream propelling fluild to permeate said core.

7. The pig of claim 4 wherein each steel bristle is in a longitudinal plane and has a forwardly inclined tip whose outermost end surface is planar.

* * * * *